US006042330A

United States Patent [19]

Egan

[11] Patent Number: 6,042,330

[45] **Date of Patent: *Mar. 28, 2000**

[54] ELECTRICALLY ACTUATED LIFTING AND TRANSFERRING APPARATUS

[76] Inventor: Thomas F. Egan, 570 Hance Rd., Binghamton, N.Y. 13903

[ * ] Notice: This patent issued on a continued prosecution application filed under 37 CFR 1.53(d), and is subject to the twenty year patent term provisions of 35 U.S.C. 154(a)(2).

[21] Appl. No.: 08/705,946

[22] Filed: Aug. 29, 1996

[51] Int. Cl.[7] ..... B66C 23/00

[52] U.S. Cl. ..... 414/680; 212/237; 212/260; 414/744.3; 414/744.5; 414/921

[58] Field of Search ..... 414/680, 540, 414/917, 744.3, 744.5, 920, 921, 703, 719, 910, 911, 543; 212/232, 237, 901, 343, 180, 260; 224/42.18, 42.21; 5/81.1 R, 83.1, 85.1, 87.1, 89.1

[56] References Cited

U.S. PATENT DOCUMENTS

| | | | |
|---|---|---|---|
| 360,578 | 4/1887 | Francis | 212/180 |
| 3,896,946 | 7/1975 | Forsyth et al. . | |
| 4,226,567 | 10/1980 | Orsdale, Jr. | 414/917 X |
| 4,270,630 | 6/1981 | Karkau . | |
| 4,306,634 | 12/1981 | Sangster | 414/921 |
| 4,365,924 | 12/1982 | Brigman et al. . | |
| 4,398,858 | 8/1983 | Paffrath . | |
| 4,420,286 | 12/1983 | Hanson et al. . | |
| 4,438,640 | 3/1984 | Willis . | |
| 4,475,861 | 10/1984 | Medansky . | |
| 4,569,094 | 2/1986 | Hart et al. . | |
| 4,573,854 | 3/1986 | McFarland . | |
| 4,616,972 | 10/1986 | McFarland . | |
| 4,644,595 | 2/1987 | Daniel . | |
| 4,661,035 | 4/1987 | Danielsson . | |
| 4,671,729 | 6/1987 | McFarland . | |
| 4,685,860 | 8/1987 | McFarland . | |
| 4,786,072 | 11/1988 | Girvin . | |
| 4,797,042 | 1/1989 | McFarland . | |
| 4,801,237 | 1/1989 | Yamamoto | 414/917 X |

(List continued on next page.)

FOREIGN PATENT DOCUMENTS

| | | | |
|---|---|---|---|
| 1484678 | 6/1989 | U.S.S.R. | 414/917 |

*Primary Examiner*—Donald W. Underwood
*Attorney, Agent, or Firm*—Thomas E. Anderson

[57] ABSTRACT

An electrically actuated lifting and transferring apparatus for assisting in the mobility of disabled persons. The electrically actuated lifting and transferring apparatus has a mounting bracket, wherein the mounting bracket has a first support means; an offset bracket, wherein the offset bracket is pivotally mounted to the first support means, and wherein the offset bracket has a second support means; a lift assembly, wherein the lift assembly is pivotally mounted to the second support means, wherein the lift assembly has a third support means, and wherein the lift assembly has an electrical actuator for vertically adjusting the height of the third support means relative to the second support means; a swing arm, wherein the swing arm is pivotally mounted to the third support means, and wherein the swing arm has a fourth support means; and a yoke for supporting a harness, wherein the yoke is pivotally mounted to the fourth support means. The offset bracket provides a vertical and horizontal extension from the mounting bracket to the lift assembly. All of the pivotal mounting is unsecured pivotal mounting whereby the apparatus is easily disassembled into the individual elements.

21 Claims, 3 Drawing Sheets

U.S. PATENT DOCUMENTS

| | | | |
|---|---|---|---|
| 4,809,998 | 3/1989 | Girvin . | |
| 4,955,779 | 9/1990 | Knackstedt | 414/723 |
| 5,035,467 | 7/1991 | Axelson et al. . | |
| 5,102,195 | 4/1992 | Axelson et al. . | |
| 5,154,563 | 10/1992 | Phillips . | |
| 5,160,236 | 11/1992 | Redding et al. . | |
| 5,201,377 | 4/1993 | Wilson . | |
| 5,205,697 | 4/1993 | Getty et al. . | |
| 5,261,779 | 11/1993 | Goodrich . | |
| 5,333,333 | 8/1994 | Mah . | |
| 5,348,172 | 9/1994 | Wilson . | |
| 5,375,913 | 12/1994 | Blanchard . | |
| 5,431,526 | 7/1995 | Peterson et al. . | |
| 5,456,335 | 10/1995 | Kinsey . | |
| 5,456,568 | 10/1995 | Kirby et al. | 901/15 X |
| 5,459,891 | 10/1995 | Reeve et al. . | |
| 5,467,813 | 11/1995 | Vermaat | 901/15 X |
| 5,540,539 | 7/1996 | Wolfman et al. | 414/921 |
| 5,617,963 | 4/1997 | Baziuk et al. | 212/202 |

ELECTRICALLY ACTUATED LIFTING AND TRANSFERRING APPARATUS

FIELD OF INVENTION

The present invention relates to devices which may be used for lifting and transferring disabled persons and, more particularly, to an electrically actuated lifting and transferring apparatus for assisting in the mobility of disabled persons.

BACKGROUND OF THE INVENTION

Disabled persons often have trouble in transferring from one location to another. Particularly in the case of wheelchair bound persons, it is often quite difficult to lift and transfer such persons to and from their wheelchair from and to, for example, a car, a bath or shower, or a bed. It can also be quite difficult to lift and transfer mobility devices such as wheelchairs and scooters after a disabled person has been removed therefrom. One or more persons are usually required to assist the disabled person.

There have been some inventive efforts directed at alleviating the problems associated with transferring disabled persons from one location to another. For example, in U.S. Pat. No. 4,365,924, Brigman et al. disclose a disabled person transfer device for transferring a disabled person from a wheelchair to a vehicle. Also, in U.S. Pat. No. 5,459,891, Reeve et al. disclose a hydraulically powered lift and transport apparatus for lifting and transporting wheelchair bound persons.

The aforementioned patents disclose devices which allow a disabled person to be lifted from a wheelchair or a bed to another location. However, the devices disclosed in both of these patents, as well as other known devices, have drawbacks in the areas of cost and complexity which could limit the potential mobility of a disabled individual. For instance, the disabled person transfer device disclosed in U.S. Pat. No. 4,365,924 requires extensive modifications to a vehicle as well as a modified wheelchair for use with the device. Also, the lift and transport apparatus disclosed in U.S. Pat. No. 5,459,891 requires a remotely located hydraulic pump and 120 VAC current to power the various components of the apparatus. Furthermore, the devices disclosed in both of the aforementioned patents are essentially permanently installed, thus lacking in portability. Similar drawbacks exist for other known lifting and transferring devices.

In view of the foregoing, it would be desirable to provide a lifting and transferring apparatus for assisting disabled persons that is compact, lightweight, and portable for use in different locations. Preferably, such an apparatus would provide multiple pivot points for providing multiple degrees of maneuvering freedom when lifting and transferring disabled persons and their mobility devices and for providing compatibility with a wide range of vehicles.

SUMMARY OF THE INVENTION

The present invention contemplates an electrically actuated lifting and transferring apparatus for assisting in the mobility of disabled persons and their mobility devices. The present invention electrically actuated lifting and transferring apparatus has a mounting bracket, wherein the mounting bracket has a first support means; an offset bracket, wherein the offset bracket is pivotally mounted to the first support means, and wherein the offset bracket has a second support means; a lift assembly, wherein the lift assembly is pivotally mounted to the second support means, wherein the lift assembly has a third support means, and wherein the lift assembly has an electrical actuator for vertically adjusting the height of the third support means relative to the second support means; a swing arm, wherein the swing arm is pivotally mounted to the third support means, and wherein the swing arm has a fourth support means; and a yoke for supporting a harness, wherein the yoke is pivotally mounted to the fourth support means. The offset bracket provides a vertical and horizontal extension from the mounting bracket to the lift assembly. All of the pivotal mounting is unsecured pivotal mounting whereby the apparatus is easily disassembled into the individual elements.

From the above descriptive summary it is apparent how the present invention overcomes the shortcomings of the above-mentioned prior art.

Accordingly, the primary object of the present invention is to provide an electrically actuated lifting and transferring apparatus for assisting in the mobility of disabled persons and their mobility devices.

The above primary object, as well as other objects, features, and advantages, of the present invention will become readily apparent from the following detailed description which is to be read in conjunction with the appended drawings.

BRIEF DESCRIPTION OF THE DRAWINGS

In order to facilitate a fuller understanding of the present invention, reference is now made to the appended drawings. These drawings should not be construed as limiting the present invention, but are intended to be exemplary only.

DETAILED DESCRIPTION OF A PREFERRED EMBODIMENT OF THE PRESENT INVENTION

Figure 1:
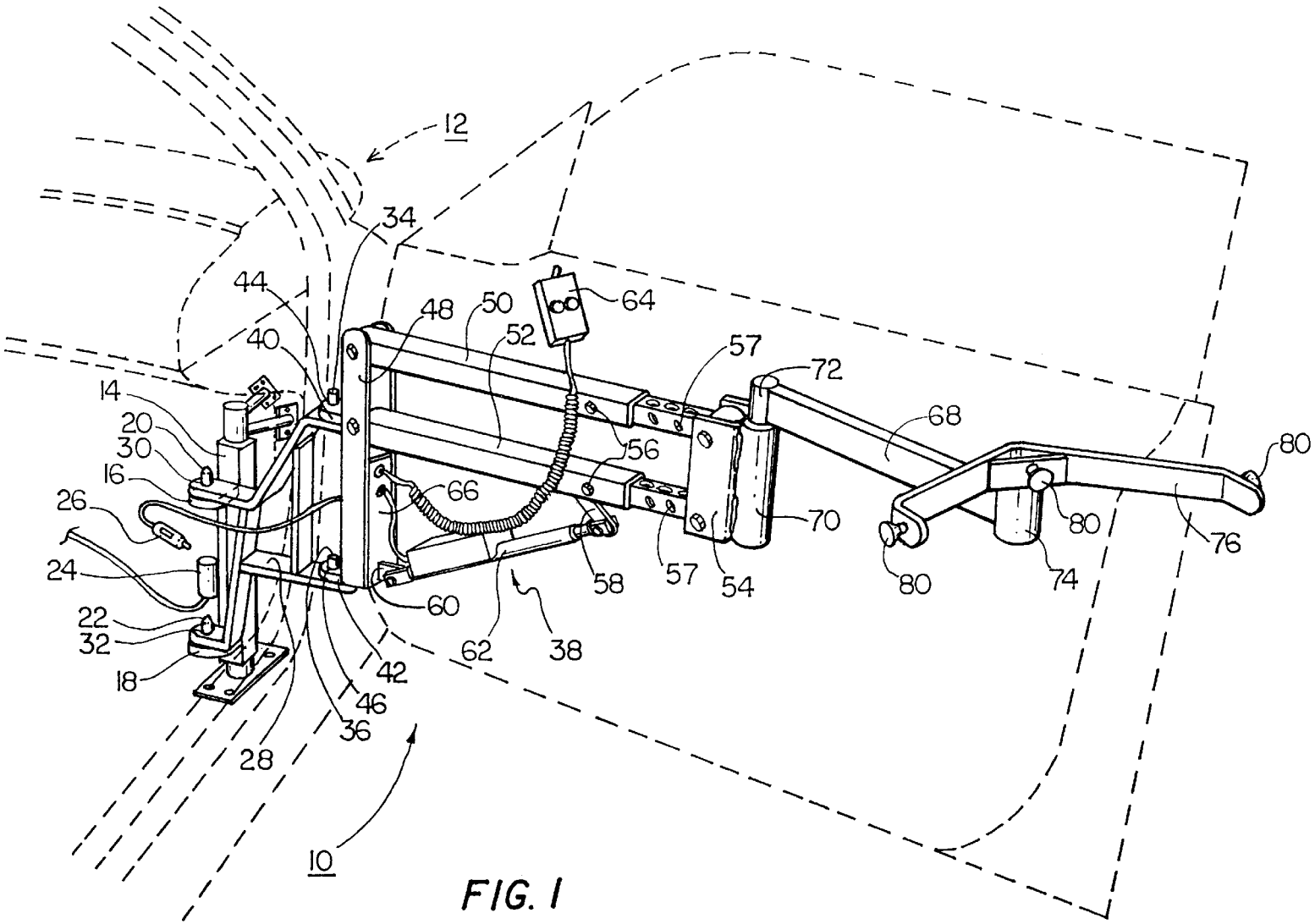
FIG. 1 is a perspective view of an electrically actuated lifting and transferring apparatus according to the present invention.

Referring to FIG. 1, there is shown a perspective view of an electrically actuated lifting and transferring apparatus 10 according to the present invention. In this particular embodiment, the apparatus 10 is shown installed in an automobile 12, although an automobile is just one of the many possible environments where the apparatus 10 may be utilized. For instance, the apparatus 10 may also be used in the home or at medical centers.

The apparatus 10 comprises a hollow mounting bracket 14 which is mounted to the automobile 12 in several places. The mounting is typically performed by inserting first and second mounting stock bars into the top and bottom ends, respectively, of the mounting bracket 14 and then welding the mounting stock bars to the mounting bracket 14. A mounting plate is then welded to the free end of the second mounting stock bar. Two additional mounting stock bars, also having mounting plates welded to first ends thereof, then have their second ends welded to the free end of the first mounting stock bar. All of the mounting plates have mounting holes drilled therein so that they can then be bolted to the automobile 12 at several structurally beneficial locations (i.e. typically at the firewall, the floorboard, and the door jam of the automobile 12).

The mounting bracket 14 has an upper pivot plate 16 and a lower pivot plate 18 attached thereto. The upper 16 and lower 18 pivot plates have a corresponding upper pivot pin 20 and a lower pivot pin 22 attached thereto. The attachments between the pivot plates 16, 18 and the mounting bracket 14 and between the pivot pins 20, 22 and the pivot plates 16, 18 are typically made by welding. The mounting bracket 14 also has a 12 VDC electrical receptacle 24 mounted thereto. The 12 VDC is typically supplied from a battery in the automobile 12. The receptacle 24 mates with an electrical plug 26 which provides power to an electrical actuator 62 of the apparatus 10 as described in detail below.

The mounting bracket 14 supports an offset bracket 28. The offset bracket 28 has an upper pivot cavity 30 and a lower pivot cavity 32 formed in the structure thereof which mate with the pivot pins 20, 22 of the mounting bracket 14. The pivot plates 16, 18 of the mounting bracket 14 provide the support for the offset bracket 28 in the areas of the mating pivot pins 20, 22 and pivot cavities 30, 32.

The offset bracket 28 also has an upper pivot pin 34 and a lower pivot pin 36 attached thereto. The attachments between the pivot pins 34, 36 and the offset bracket 28 are typically made by welding.

Figure 5:
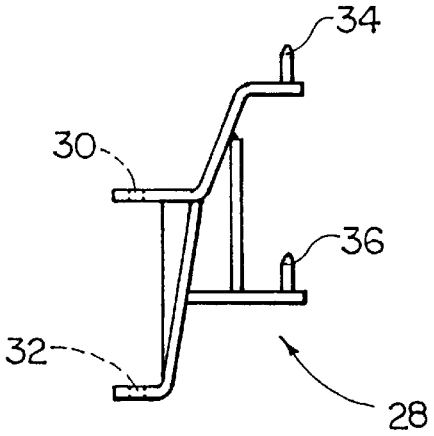
FIG. 5 is a side view of the offset bracket.

The offset bracket 28 provides an essential feature to the apparatus 10 by allowing a lift assembly 38, which is described in detail below, to be utilized in automobiles of all makes and models. The offset bracket 28 allows this utilization by providing both a vertical and a horizontal extension between the mounting bracket 14 and the lift assembly 38, thereby allowing the lift assembly 38 to be effectively mounted to the mounting bracket 14 through a double pivoting arrangement. The offset bracket 28 is particularly beneficial in automobiles having low dashboards, since a secure mounting position of the mounting bracket 14 under the dashboard of such vehicles would otherwise prohibit a direct mounting of the lift assembly 38 to the mounting bracket 14 or would otherwise substantially limit the useful range of motion of the apparatus 10. FIG. 5 provides an isolated side view of the offset bracket 28.

The offset bracket 28 supports the lift assembly 38. The lift assembly 38 has an upper pivot plate 40 and a lower pivot plate 42 attached to a first vertical lift section 48 thereof. The upper 40 and lower 42 pivot plates have a corresponding upper pivot cavity 44 and a lower pivot cavity 46 formed therein which mate with the pivot pins 34, 36 of the offset bracket 28. The attachments between the pivot plates 40, 42 and the first vertical lift section 48 are typically made by welding.

The lift assembly 38 also comprises an upper horizontal lift section 50 and a lower horizontal lift section 52 which at first ends thereof are pivotally mounted to the first vertical lift section 48. The upper 50 and lower 52 horizontal lift sections are also pivotally mounted at second ends thereof to a second vertical lift section 54. The upper 50 and lower 52 horizontal lift sections are lengthwise adjustable in a telescoping fashion by securing adjustment bolts 56 through adjustment holes 57 in the upper 50 and lower 52 horizontal lift sections.

The lower horizontal lift section 52 has a mounting bracket 58 attached thereto on the underside thereof, and the first vertical lift section 48 has a similar mounting bracket 60 attached to the lower end thereof. The attachments between these mounting brackets 58, 60 and the lower horizontal lift section 52 and the first vertical lift section 48, respectively, are typically made by welding. An electrical actuator 62 is pivotally mounted between these two mounting brackets 58, 60.

Figure 3:
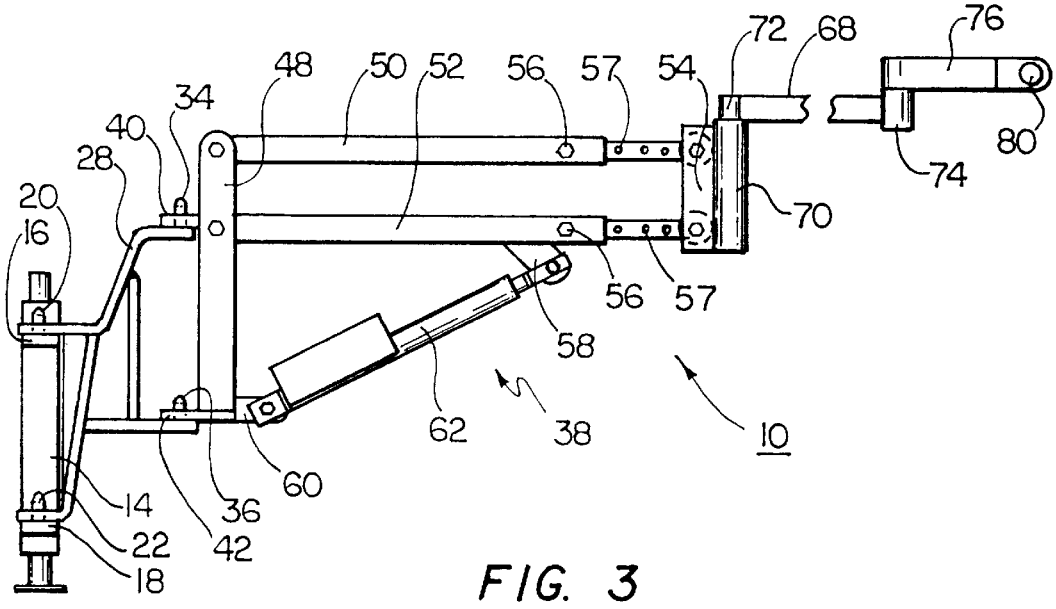
FIG. 3 is a side view of the electrically actuated lifting and transferring apparatus shown in FIG. 1 with the ram of the electrical actuator in a retracted position.
Figure 4:
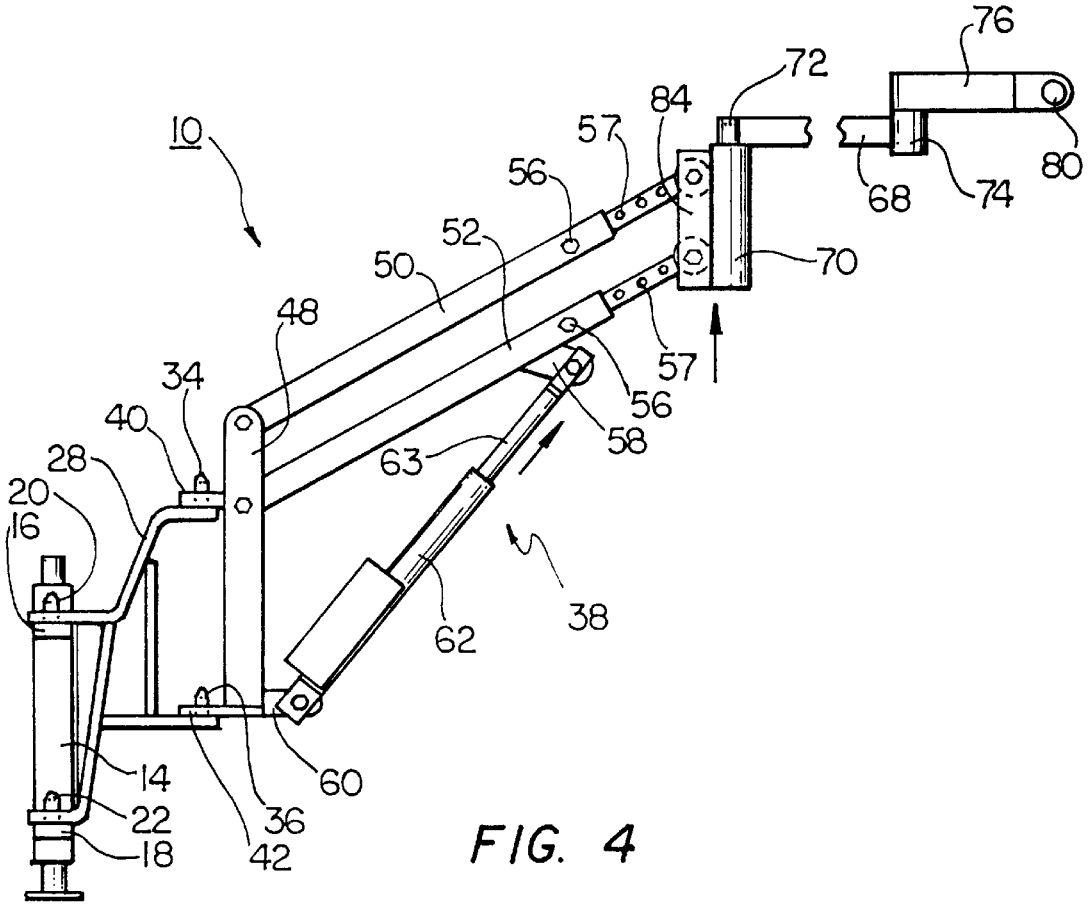
FIG. 4 is a side view of the electrically actuated lifting and transferring apparatus shown in FIG. 1 with the ram of the electrical actuator in an extended position.

The electrical actuator 62 operates in such a manner that it exerts positive force only when extending its ram 63 (see FIG. 4). That is, the electrical actuator 62 only drives the ram 63 in a positive manner to an extended position (see FIG. 4). The electrical actuator 62 allows the ram 63 to return to a retracted position (see FIG. 3) through gravitational force. It should be noted, however, that the electrical actuator 62 maintains the ram 63 in an extended position for as long as is desired by an operator of the apparatus 10, which is usually until the operator of the apparatus 10 desires to lower a disabled person or their mobility device onto a desired location. The electrical actuator 62 operates in this manner for safety reasons so as to prevent limbs and/or other objects from being crushed beneath or pinched between the upper 50 and lower 52 horizontal lift sections and the electrical actuator 62 itself. The operation of the electrical actuator 62 will be described in further detail below.

The lift assembly 38 further comprises a control unit 64, which is used to control the position of the electrical actuator 62. The control unit 64 is electrically connected, in an housing 66 in the first vertical lift section 48, to both the electrical actuator 62 and the 12 VDC power source through the electrical receptacle/plug combination 24, 26. The control unit 64 essentially performs a switching function between the 12 VDC power source and the electrical actuator 62.

The second vertical lift section 54 supports a swing arm 68 through a hollow cylindrical housing 70 which retains a bushing therein. The swing arm 68 has a pivot pin 72 which is pivotally mated with the hollow cylindrical housing 70, and hence the bushing retained therein. The attachment of the hollow cylindrical housing 70 to the second vertical lift section 54 and the attachment of the pivot pin 72 to the swing arm 68 are typically made by welding.

Figure 2:
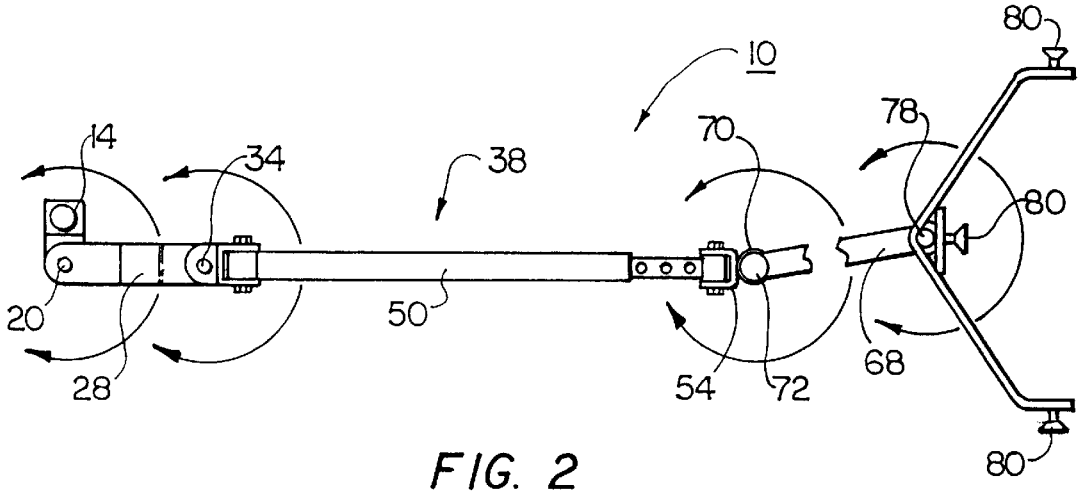
FIG. 2 is a top view of the electrically actuated lifting and transferring apparatus of FIG. 1 indicating the four pivot points about which a disabled person may be maneuvered.

Similar to the second vertical lift section 54, the swing arm 68 also has a hollow cylindrical housing 74 which retains a bushing therein. The swing arm 68 employs this housing 74 to support a yoke 76. Similar to the swing arm 68, the yoke 76 has a pivot pin 78 (see FIG. 2) which is pivotally mated with the hollow cylindrical housing 74, and hence the bushing retained therein. The attachment of the hollow cylindrical housing 74 to the swing arm 68 and the attachment of the pivot pin 78 to the yoke 76 are typically made by welding.

The yoke 76 has several beveled posts 80 onto which a harness (not shown) is attached for the purpose of lifting and transferring disabled individuals. The posts 80 are beveled so as to prevent the harness from slipping off the posts 80, thereby providing positive securement of the harness. The beveled posts 80 are typically attached to the yoke 76 by welding.

As previously mentioned, one of the essential features of the electrically actuated lifting and transferring apparatus 10 is the offset bracket 28, which expands the number of points about which a disabled person may be pivotally maneuvered. In fact, referring to FIG. 2, it can be seen that apparatus 10 has four pivot points about which a disabled person may be maneuvered. The location of the first of these pivot points coincides with the pivot pins 20, 22 of the mounting bracket 14. The offset bracket 28 may be pivotally moved about this first pivot point. The location of the second pivot point coincides with the pivot pins 34, 36 of the offset bracket 28. The offset bracket 28 and the lift assembly 38 may be pivotally moved about this second pivot point with respect to each other. The location of the third pivot point coincides with the pivot pin 72 of the swing arm 68. The lift assembly 38 and the swing arm 68 may be pivotally moved about this third pivot point with respect to each other. The location of the fourth pivot point coincides with the pivot pin 78 of the yoke 76. The swing arm 68 and the yoke 76 may be pivotally moved about this fourth pivot point with respect to each other.

Referring to FIG. 3, the electrically actuated lifting and transferring apparatus 10 is shown with the ram 63 of the electrical actuator 62 in a retracted position. When the ram 63 of the electrical actuator 62 is in this position (i.e. when the yoke 76 is at its lowest vertical point), a harness may be easily attached to the apparatus 10 after it has been securely wrapped around a disabled person to be lifted. That is, with the yoke 76 of the apparatus 10 being at its lowest vertical point, there should be sufficient slack in the harness so as to allow it to be attached to the beveled posts 80 of the yoke 76.

Referring to FIG. 4, the electrically actuated lifting and transferring apparatus 10 is shown with the ram 63 of the electrical actuator 62 in an extended position. When the ram 63 of the electrical actuator 62 is in this position (i.e. when the yoke 76 is at its highest vertical point), a disabled person being carried in the harness may be maneuvered over a destination location such as, for example, a seat in the automobile 12.

It should be noted that the pivotal maneuvering allowed by the four pivot points of the apparatus 10 can be utilized when the ram 63 of the electrical actuator 62 is in either a retracted or an extended position, or anywhere in between.

Another important feature of the electrically actuated lifting and transferring apparatus 10 is the portability of the apparatus 10. The only permanently installed component of the apparatus 10 is the mounting bracket 14. Thus, after a disabled person or their mobility device has been transferred into or out of the automobile 12, the rest of the apparatus 10 can be easily removed from the pivot pins 20, 22 of the mounting bracket 14. In fact, the apparatus 10 can be easily disassembled at each of the four pivot points for convenient storage or for the addition or the removal of the individual components of the apparatus 10. For example, the yoke 76 can be removed by simply withdrawing the pivot pin 78 of the yoke 76 from the hollow cylindrical housing 74 of the swing arm 68. It should be noted that there may be several different types of yokes for lifting and transferring different types of loads (i.e. one type of yoke 76 to which a harness may be attached for lifting and transferring disabled persons, and another type of yoke to which mobility devices may be directly attached).

Since the bulk of the apparatus 10 is portable, the apparatus 10 can be used at several different locations by simply having a mounting bracket 14 secured at each of the locations. For example, mounting brackets 14 can be installed in several automobiles or in household bedrooms and bathrooms.

The electrically actuated lifting and transferring apparatus 10 is very durable and its structure is designed to lift and transfer up to 275 pounds. Meanwhile, the weight of the apparatus 10 is only about 35 pounds and the electrical actuator 62 requires only about 7 Amps of continuous power.

The present invention is not to be limited in scope by the specific embodiment described herein. Indeed, various modifications to the present invention, in addition to those described herein, will be apparent to those of skill in the art from the foregoing description and accompanying drawings. Thus, such modifications are intended to fall within the scope of the appended claims. Additionally, various references are cited throughout the specification, the disclosures of which are each incorporated herein by reference in their entirety.

What is claimed is:

1. An electrically actuated lifting and transferring apparatus, said apparatus comprising:

a mounting bracket securable to a support structure, said mounting bracket having a first support;

an offset bracket pivotally mounted to said first support so as to allow pivotal movement of said offset bracket about a first substantially vertical axis, said offset bracket having a second support;

a lift assembly pivotally mounted to said second support so as to allow pivotal movement of said lift assembly about a second substantially vertical axis, said lift assembly having a third support, said lift assembly having an electrical actuator for vertically adjusting the height of said third support relative to said second support by providing a positive force to raise said third support relative to said second support and by allowing gravitational force to lower said third support relative to said second support;

a swing arm pivotally mounted to said third support so as to allow pivotal movement of said swing arm about a third substantially vertical axis, said swing arm having a fourth support; and a yoke pivotally mounted to said fourth support so as to allow pivotal movement of said yoke about a fourth substantially vertical axis.

2. The apparatus as defined in claim 1, wherein said offset bracket provides a substantially horizontal extension from said mounting bracket to said lift assembly.

3. The apparatus as defined in claim 1, wherein said offset bracket provides a vertical and horizontal extension from said mounting bracket to said lift assembly.

4. An electrically actuated lifting and transferring apparatus, said apparatus comprising:

a mounting bracket securable to a support structure, said mounting bracket having a first support;

an offset bracket pivotally mounted to said first support so as to allow pivotal movement of said offset bracket about a first substantially vertical axis, said offset bracket having a second support; and a lift assembly pivotally mounted to said second support so as to allow pivotal movement of said lift assembly about a second substantially vertical axis, said lift assembly having a third support, said lift assembly having an electrical actuator for vertically adjusting the height of said third support relative to said second support by providing a positive force to raise said third support relative to said second support and by allowing gravitational force to lower said third support relative to said second support.

5. The apparatus as defined in claim 1, wherein said yoke includes at least one beveled post for supporting and positively retaining a harness.

6. The apparatus as defined in claim 1, wherein said electrical actuator is operated by a hand-held control unit.

7. The apparatus as defined in claim 4, wherein said offset bracket provides a substantially horizontal extension from said mounting bracket to said lift assembly.

8. The apparatus as defined in claim 4, wherein said offset bracket provides a vertical and horizontal extension from said mounting bracket to said lift assembly.

9. The apparatus as defined in claim 1, wherein at least one of said pivotal mountings includes at least one freely separable pivot pin and pivot cavity arrangement configured to allow a pivotally mounted element to be freely dismounted from its corresponding support by merely raising the pivotally mounted element substantially along its corresponding substantially vertical pivot axis.

10. The apparatus as defined in claim 9, wherein all of said pivotal mountings include at least one freely separable pivot pin and pivot cavity arrangement configured to allow each pivotally mounted element to be freely dismounted from its corresponding support by merely raising each pivotally mounted element substantially along its corresponding substantially vertical pivot axis.

11. An electrically actuated lifting and transferring apparatus, said apparatus comprising:

a mounting bracket securable to a support structure, said mounting bracket having a first support;

a lift assembly pivotally mounted to said first support so as to allow pivotal movement of said lift assembly about a first substantially vertical axis, said lift assembly having a second support, said lift assembly having an electrical actuator for vertically adjusting the height of said second support relative to said first support by providing a positive force to raise said second support relative to said first support and by allowing gravitational force to lower said second support relative to said first support;

a swing arm pivotally mounted to said second support so as to allow pivotal movement of said swing arm about a second substantially vertical axis, said swing arm having a third support; and a yoke pivotally mounted to said third support so as to allow pivotal movement of said yoke about a third substantially vertical axis.

12. The apparatus as defined in claim 11, wherein said yoke includes at least one beveled post for supporting and positively retaining a harness.

13. The apparatus as defined in claim 4, wherein said electrical actuator is operated by a hand-held control unit.

14. The apparatus as defined in claim 11, wherein said electrical actuator is operated by a hand-held control unit.

15. The apparatus as defined in claim 11, wherein at least one of said pivotal mountings includes at least one freely separable pivot pin and pivot cavity arrangement configured to allow a pivotally mounted element to be freely dismounted from its corresponding support by merely raising the pivotally mounted element substantially along its corresponding substantially vertical pivot axis.

16. The apparatus as defined in claim 15, wherein all of said pivotal mountings include at least one freely separable pivot pin and pivot cavity arrangement configured to allow each pivotally mounted element to be freely dismounted from its corresponding support by merely raising each pivotally mounted element substantially along its corresponding substantially vertical pivot axis.

17. The apparatus as defined in claim 4, further comprising:

a swing arm pivotally mounted to said third support so as to allow pivotal movement of said swing arm about a third substantially vertical axis.

18. The apparatus as defined in claim 17, wherein said swing arm has a fourth support, further comprising:

a yoke pivotally mounted to said fourth support so as to allow pivotal movement of said yoke about a fourth substantially vertical axis.

19. The apparatus as defined in claim 18, wherein said yoke includes at least one beveled post for supporting and positively retaining a harness.

20. The apparatus as defined in claim 18, wherein at least one of said pivotal mountings includes at least one freely separable pivot pin and pivot cavity arrangement configured to allow a pivotally mounted element to be freely dismounted from its corresponding support by merely raising the pivotally mounted element substantially along its corresponding substantially vertical pivot axis.

21. The apparatus as defined in claim 20, wherein all of said pivotal mountings include at least one freely separable pivot pin and pivot cavity arrangement configured to allow each pivotally mounted element to be freely dismounted from its corresponding support by merely raising each pivotally mounted element substantially along its corresponding substantially vertical pivot axis.

* * * * *